US005158181A

United States Patent [19]

Bailey

[11] Patent Number: 5,158,181

[45] Date of Patent: Oct. 27, 1992

[54] OPTICAL SORTER

[76] Inventor: Roger F. Bailey, 3106 Battle Ridge La., Sugar Land, Tex. 77479

[21] Appl. No.: 348,277

[22] Filed: May 5, 1989

Related U.S. Application Data

[63] Continuation-in-part of Ser. No. 932,738, Oct. 28, 1986, Pat. No. 4,863,041.

[30] Foreign Application Priority Data

Oct. 29, 1985 [AU] Australia ..... PH3259

[51] Int. Cl.[5] ..... B07C 5/342

[52] U.S. Cl. ..... 209/558; 209/576; 209/577; 209/581; 209/585; 209/586; 209/587

[58] Field of Search ..... 209/555, 556, 558, 576, 209/577, 580–582, 586–588; 250/226; 356/425; 364/579, 580

[56] References Cited

U.S. PATENT DOCUMENTS

| | | | |
|---|---|---|---|
| 3,709,612 | 1/1973 | Clemens | 356/425 X |
| 3,993,899 | 11/1976 | Chapman | 250/226 X |
| 4,041,286 | 8/1977 | Sanford | 364/579 X |
| 4,131,367 | 12/1978 | French et al. | 356/425 X |
| 4,143,770 | 3/1979 | Grimmell et al. | 209/558 |
| 4,186,838 | 2/1980 | Levitt et al. | 209/581 |
| 4,454,029 | 6/1984 | Codding | 209/581 |
| 4,513,868 | 4/1985 | Culling et al. | 209/581 |
| 4,676,638 | 6/1987 | Yasuda . | |
| 4,735,323 | 4/1988 | Okada et al. . | |
| 4,784,275 | 11/1988 | Fridge | 209/580 X |
| 5,062,532 | 11/1991 | Zivley | 209/581 |

FOREIGN PATENT DOCUMENTS

| | | | |
|---|---|---|---|
| 0109686 | 5/1984 | European Pat. Off. | 209/580 |
| 0147320 | 4/1981 | Fed. Rep. of Germany | 209/586 |
| 61-110016 | 5/1986 | Japan | 209/582 |
| WO87/01975 | 4/1987 | PCT Int'l Appl. | 209/580 |
| 0484903 | 1/1976 | U.S.S.R. | 209/580 |
| 484903 | 1/1976 | U.S.S.R. | 209/580 |
| 2136957 | 9/1984 | United Kingdom . | |
| 2142426 | 1/1985 | United Kingdom | 209/577 |

*Primary Examiner*—Michael S. Huppert
*Assistant Examiner*—Edward M. Wacyra
*Attorney, Agent, or Firm*—Bernard A. Reiter

[57] ABSTRACT

A sorter is described that optically differentiates acceptable objects from unacceptable objects. The sorter illuminates the objects as they move in a stream through a viewing zone with both visible and infrared light. The detecting system and circuit provides electric signals proportional to the light transmitted or reflected by the objects to a microcomputer system which in turn activates a rejection mechanism if unacceptable objects are viewed. The microcomputer system determines what objects are unacceptable by comparing signals for objects being viewed with stored signals for acceptable objects.

16 Claims, 2 Drawing Sheets

OPTICAL SORTER

This is a continuation-in-part of co-pending U.S. patent application Ser. No. 932,738, filed Oct. 28, 1986.

BACKGROUND OF THE INVENTION

The present invention relates to optical sorting apparatus and methods for sorting individual objects such as beans, nuts, seeds, or other agricultural products to detect optically discernible defects in the objects.

Presently, various apparatus exist for carrying out optical sorting of objects. Generally, these apparatus include a feeding device which separates a quantity of objects into individual streams of moving objects. The object streams pass through viewing zones where the individual objects are illuminated. Light reflected from each of the illuminated objects is collected by one or more photo-amplifiers and analyzed to determine if the object is acceptable.

When sorting is based on color, at least two photoamplifiers are typically provided. Each photo-amplifier responds to a region of the light frequency spectrum. The photo-amplifiers produce electric signals which are proportional to the intensity of the light detected. The electric signals are processed by an electronic circuit which determines whether a given object is acceptable based on its electric signal. The electronic circuit activates a rejection mechanism that separates an unacceptable object from the object stream when the unacceptable object is detected.

A number of problems and disadvantages exist with known sorting apparatus. Typically they use painted backgrounds as color references for optically sorting objects. For example, a photo-amplifier concurrently receives light reflected from an object being viewed and a painted background with the same color as an acceptable object of the type being viewed. If the light reflected from the object being viewed does not closely match the light reflected from the painted background with the same color as an acceptable object of that type, the electric signal produced is analyzed as unacceptable and the object is rejected.

The color reference provided by a painted background must typically match the acceptable color as predetermined for a particular type of object to within a 1 to 1.5% tolerance. Consequently, numerous backgrounds are necessary given the wide variation in colors for different types of objects. For example, when known sorting devices are used to sort peanuts and then coffee beans a change of painted backgrounds is required. Likewise, to switch from sorting one grade of coffee bean to another a change of backgrounds is required. Further, determining the appropriate color reference for a particular type of object may require extensive research.

Painted backgrounds in known sorting apparatus deteriorate and get dirty thereby causing problems. The color of a deteriorated or dirty background frequently does not match the color reference for acceptable objects that it was designed to match. Consequently, when acceptable objects are optically compared to deteriorated or dirty backgrounds the acceptable objects may be rejected.

Viewing heads for known optical sorting apparatus are relatively bulky for the viewing area they provide. For example, a viewing head with a 30 cm outside diameter may provide only a 5 cm viewing zone. The diameter disparity is necessary to allow the viewing head to accommodate lamps for illuminating the viewing zone as well as space intensive equipment such as lenses, photo-amplifiers, and filters. Lamps used in known viewing heads also generate a substantial amount of heat which affects response characteristics of the photo-amplifiers and causes deterioration of the backgrounds. The amount and proximity of equipment provided in known viewing heads creates additional problems such as limiting the number of viewing channels available due to a lack of space, and causing electrical interference in the photo-amplifier circuits due to the lamp power-circuits.

Known optical sorting apparatus also have the problem of rejecting an acceptable object when defects are detected in the proximate end of a nearby, unacceptable object. This problem typically occurs in two ways: First, imprecision in the timing mechanism may cause the rejection of an acceptable object passing through the viewing zone either immediately before, or after, the defective object. Second, known viewing mechanisms may associate a defect at either end of an unacceptable object with both the unacceptable object and an acceptable object passing through the viewing zone either immediately before, or after, the unacceptable object. These problems particularly occur when the objects being sorted are bunched together in the object stream—i.e., when the spacing between objects is small.

Faulty alignment of viewing heads and viewing assemblies in known sorting apparatus also leads to incorrect sorting operations. Two forms of alignment are necessary for proper sorting. First, the viewing head is aligned with respect to the object stream. This may need to be done on a regular basis, particularly when the device is used to sort a wide range of objects. Second, each viewing assembly is separately adjusted with respect to the viewing head and object stream. The viewing assemblies ideally are adjusted to form a flat circle around the object stream. This insures that all views are synchronized, resulting in actuation of the rejection mechanism at substantially the same time regardless of which viewing assembly actually sees the defect in an unacceptable object.

Rejection of acceptable objects as a result of dirt clouding the windows and lenses of viewing assemblies has also been a problem associated with known optical sorting apparatus. Consequently, the windows and lenses of the viewing assemblies must either be frequently cleaned or the electronic detector circuit must be regularly adjusted to compensate for the loss in photo-amplifier signal strength due to the dirty windows and lenses. Otherwise, an acceptable object may be rejected due to loss in photo-amplifier signal strength.

SUMMARY OF THE INVENTION

The invention provides a method and apparatus for sorting and separating objects such as agricultural products based on optically discernible characteristics or "defects". A preferred method according to the invention comprises the following steps: illuminating an object to be sorted with electromagnetic energy such as light as it moves through a viewing zone; detecting the light reflected by or transmitted through the object and converting it into an electric signal proportional to its intensity; comparing the electric signal for the detected light with a pre-determined electric signal value or "signature" for an acceptable object; and rejecting the object when the electric signal for the detected light differs from the electric signature. The electric signature for an acceptable object is developed by performing the method on hand-selected objects that are acceptable except that the electric signals for detected light from the acceptable objects are stored for reference as the electric signature. Additionally, a second, different electromagnetic energy such as infrared radiation is used to determine when the object enters the viewing zone, how fast the object is falling, and how long it takes the object to traverse the viewing zone.

The invention provides an optical sorting apparatus which alleviates the disadvantages and problems of known sorting apparatus. The invention does not use painted backgrounds as color references to provide a comparative reflective surface for optically determining if an object is acceptable. Instead, a number of pre-selected acceptable objects are optically viewed and a reference electric signature for the photo-amplifier signals from the acceptable objects is obtained and stored in memory. A microcomputer compares the electric signal for a viewed object with the stored electric signature for acceptable objects and activates the rejection mechanism when they do not match within operator determinable limits.

When the type of objects being sorted changes, the operator of the sorter simply repeats the electric signature procedure with pre-selected acceptable objects of the new type. For example, the electric signature can be reset when switching from peanuts to coffee beans, or even from one type of coffee bean to another. Further, the lack of painted backgrounds reduces or eliminates the need for extensive laboratory research to find the right color reference for a particular type of object. Likewise, problems associated with deteriorated or dirty backgrounds are reduced or eliminated by the absence of painted backgrounds.

The invention addresses problems that result from the amount and proximity of equipment packed into viewing heads of known apparatus, and problems caused by the bulkiness of the viewing heads. The invention uses optical fibers for transmitting both the illuminating light and the detected light. The lamps, filters, photoamplifiers, and electrical circuitry are located remote from the viewing head. Consequently, only the lenses and the ends of the optical fibers are located in the viewing head thereby reducing or eliminating the crowding and bulkiness of known viewing heads. Further, this arrangement reduces problems due to heat effects on the photo-amplifiers from the lamps because the lamps are separated from the photo-amplifiers. Likewise, electrical interference to the photo-amplifier circuits from the lamp power-circuits is reduced or eliminated. Additionally, the reduction or elimination of crowding in the viewing head makes it possible to add more viewing assemblies than would otherwise be feasible with viewing heads for known sorting apparatus.

Improper rejection of acceptable objects due to bunching of objects in the object stream is alleviated by the invention. The use of light photo-amplifiers along with two sets of infrared (IR) photo-amplifiers enables a more precise measurement of size and rate of fall of a defective object than is possible with known sorting apparatus and reduces or eliminates imprecise activation of the rejection mechanism. Specifically, the two sets of IR photo-amplifiers are positioned in different planes perpendicular to the object stream and allow a precise measurement of the rate of fall as determined by the time it takes an individual object to fall past those two points. The rejection mechanism is then activated based upon the exact rate of fall as calculated by a microcomputer. Further, the combination of signals from the visual and IR detectors associate a defect with the corresponding object by determining the presence and size of the object as it is viewed. This contrasts with known apparatus which can only determine the presence of a defect, but can not associate the defect with an object because the acceptably colored part of the object cannot be distinguished from the painted background.

The invention also overcomes problems due to clouding of the viewing lenses or windows with dirt. This is accomplished by monitoring the intensity of the IR detector signals when no object is being viewed. As clouding occurs, the strength of the IR signal decreases and the microcomputer system adjusts to compensate for the signal loss due to clouding. When maximum compensation has been made, the microcomputer system indicates that the viewing lenses and windows need cleaning. This reduces shutdowns for frequent cleaning, as well as reducing or eliminating improper rejection of acceptable objects when the viewing lenses or windows are dirty.

Known optical sorters use photo-amplifier lenses with a fixed focal point. This may cause rejection of acceptable objects in certain situations. For example, if an acceptable object does not fall exactly through the focal point of the photo-amplifier lens, the corresponding signal may be inaccurate. This occurs because the lens views a larger area of the object than would otherwise occur if the object fell exactly through the focal point and the size of the area viewed of an object may affect the intensity of detected light. The invention attacks this problem by focusing lenses at infinity. Consequently, the same signal is produced regardless of where an object falls relative to the photo-amplifier lens because it views the same size area of the object regardless of the object's proximity to the lens.

It must also be realized that the invention also has the ability to determine how long the object was outside the acceptable level as determined by the operator. The operator also has the ability to determine how long, and how many times, each object will be allowed to exceed the acceptable level of object color.

The operator also has the ability to adjust the electronics to allow any combination of viewing assemblies to register the defect.

Various apparatus exist that will reject the object if one photo-amplifier assembly detects any color exceeding the color tolerance set by the operator. The present invention allows the ability for more than one photo-amplifier to detect the color exceeding this operator adjusted level before the object is determined as being unacceptable. The combination may be "any" to see, "all" to see, or any combination of photo-amplifiers based on their relationship to each other.

It must be realized that with the ability of determining the length of the object, the size of the object, the shape of the object, the position of the defect, the length of the defect, the cross sectional size of the defect, the shape of the defect, the number of defects per object and their location, the operator has an almost infinite ability to accept or reject objects based on object size and shape as well as defect size and shape and the number and location of the defect(s) on each object.

The operator also has the ability to reject an object that has no defects and accept an object that has any defect.

Current apparatus use one rejection mechanism per viewing area. The present invention has the ability to operate one or more rejection mechanisms per viewing area. These rejection mechanisms may be selected so that one rejects only the color defects and another rejects only the size defects. However, it must be realized that the operator independently has the ability to combine size of the object, the shape of the object, the size of the defect, the shape of the defect, position and number of each defect of unacceptable colors with any or all of the rejection mechanisms.

The present invention has the ability to accept dark brown defects that are of small size and reject dark brown defects that are of large size. Or the opposite if decided by the operator. This ability is not available in current apparatus.

In known apparatus the time delay and duration of the operation of the rejection mechanism is preset for the type of object to be rejected.

The present invention allows the rejection mechanism to be individually adjusted for each object. The output from an IR photo-amplifier beam located in a plane below or above a red and green viewing area of the viewing head is compared with the output of another IR photo-amplifier which is synchronized to the red and green photoamplifiers, and the two IR outputs are used to give a time lapse for an object to pass between the first and second IR beam.

This time duration is then stored in memory and used to determine the proper time to start the rejection mechanism. This starting time varies for each object as determined by the speed of the object through the viewing zone.

The rejection mechanism remains on for the proper time to reject each defective object. The duration of this "on time" will vary for each defective object because of variations in the individual object lengths, and the "on time" is determined as a function of the detecting and signal processing circuits. The operator has the ability to adjust the "on time" as a function of object length, but it must be realized that the actual "on time" of the rejection mechanism may vary for each object to be rejected.

Various results may be stored by the present invention and these may include, but are not limited to, the number of objects rejected for each set of criteria including individual colors, location of defect(s), number of defects, size of defects, and size, shape and orientation of the object.

Because of the ability to count each object piece, not just the number of defective pieces, the invention has the ability to automatically adjust the feeder mechanism to maintain a constant throughput.

Various alarm messages are available to the operator that will indicate abnormal operation. These include, but are not limited to, dirty glass, too many objects of a certain type being rejected, reject mechanism operating erratically, no air pressure, illuminating lamp(s) not bright enough, and insufficient or too many objects being conveyed. The operator has the ability to override these alarm situations or correct them.

Further, the invention requires significantly less illumination than is required in known sorting apparatus. In known sorting apparatus the entire viewing zone is illuminated to provide sufficient reflected light from the object and painted background for the photo-amplifiers. In contrast, the apparatus of the invention illuminates only the object because there is no painted background that needs to be illuminated. Consequently, the lamp power required for the apparatus of the invention is less than is required for known sorting apparatus.

DETAILED DESCRIPTION OF THE INVENTION

DETECTING AND OBJECT SENSING MEANS

Figure 1:
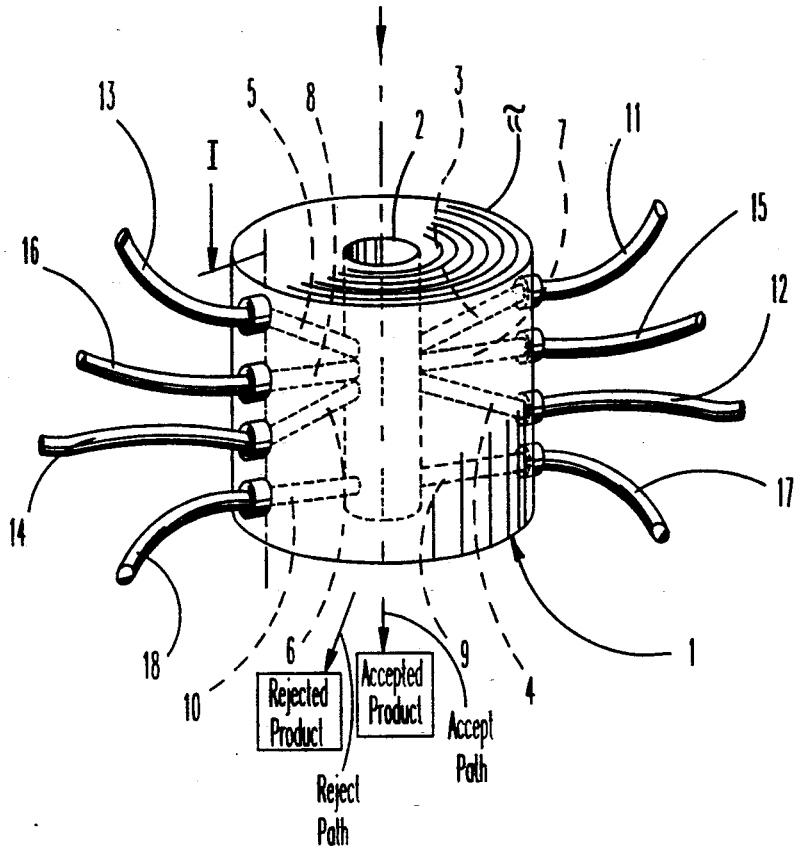
FIG. 1 is a perspective view of a viewing head for an embodiment of the present invention.
Figure 2:
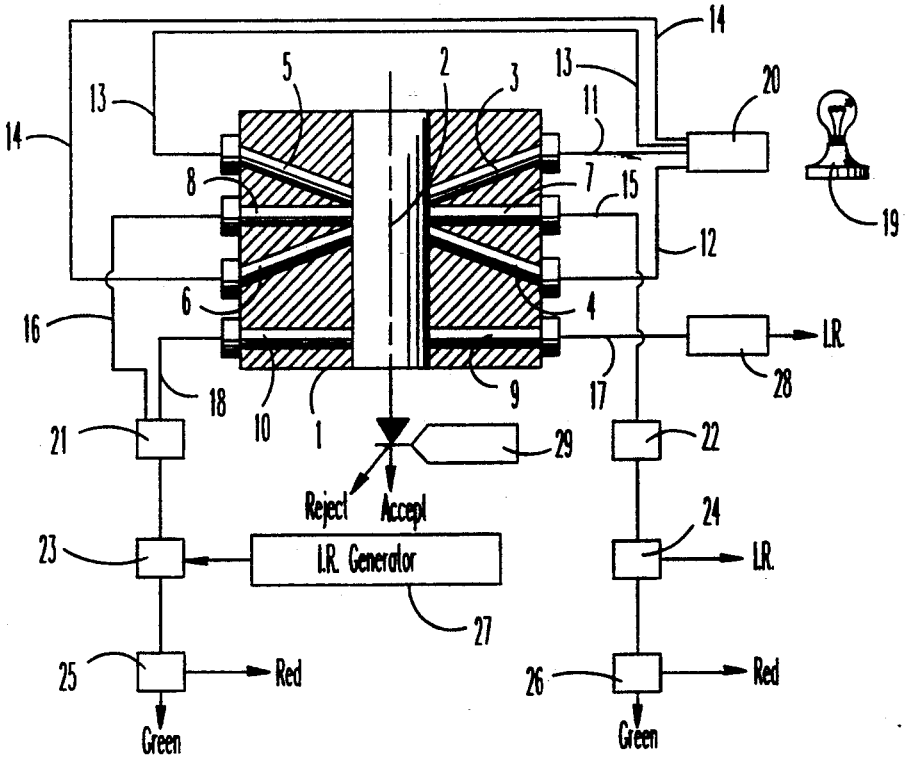
FIG. 2 is a cross-sectional view of the viewing head of FIG. 1 taken along the section lines II—II of FIG. 1.

Referring to FIG. 1, a perspective drawing of a viewing head 1 of the optical sorting apparatus for the invention is shown. FIG. 2, likewise, shows a crosssectional view of the viewing head 1. The viewing head 1 encloses a cylindrical viewing zone 2, and objects to be viewed move axially through the center of the viewing zone 2 in an object stream.

The viewing head 1 includes four illuminating assemblies 3–6; two combination viewing/IR assemblies 7 and 8; and two IR assemblies 9 and 10. The viewing/IR assemblies 7 and 8 are preferably arranged in the viewing head 1 parallel to the end faces of the viewing head, and each viewing/IR assembly points to the center of the viewing zone 2. Preferably the illuminating assemblies 3 and 5 are arranged in the viewing head directly above the viewing/IR assemblies 7 and 8, respectively, such that the path of the light projected by the illuminating assemblies and reflected by an object in the viewing zone forms an acute angle between the illuminating assemblies and the viewing/IR assemblies where the vertex of the angle is located at the center of the viewing zone. Likewise, the illuminating assemblies 4 and 6 are located directly below viewing/IR assemblies 7 and 8 respectively, such that the light projected from them forms an acute angle with the vertex at the center of the viewing zone. This arrangement helps to insure that no light is collected by the viewing/IR assemblies 7 and 8 unless some part of an object is in the center of the viewing zone 2 and reflects that light to the viewing/IR assemblies.

The illuminating assemblies 3–6 are connected to one end of optic fiber bundles 11–14, respectively. Each illuminating assembly 3–6 is supplied with light via optic fiber bundles 11–14 from a commercially available light source 19 remote to the viewing head 1. Light from the light source 19 is transmitted into the ends of optic fiber bundles 11–14 that are remote to the viewing head 1 by a light source focusing means 20. The light source focusing means 20 comprises a series of lenses to collect, focus, and project light from the light source to the ends of the optic fiber bundles.

The light source 19 may provide white light and comprise a quartz halogen incandescent lamp. Alternately, the light source may be replaced by a substantially monochromatic light source such as an array of light emitting diodes (LEDs). The LED array may be selected to provide an output having any convenient light frequency or color.

The optic fiber bundles 11–14 are formed from individual optic fibers and may have any suitable length and cross section. The optic fibers may comprise glass, plastic, or other suitable material.

The viewing/IR assemblies 7 and 8 are connected to one end of optic fiber bundles 15 and 16, respectively. Similarly, IR assemblies 9 and 10 are connected to one end of optic fiber bundles 17 and 18, respectively. Each optic fiber bundle 15–18 comprises multiple optic fibers of any suitable length and cross section which may comprise glass, plastic, or other suitable material.

The illumination assemblies 3–6, viewing/IR assemblies 7 and 8, and IR assemblies 9 and 10, each comprise a set of lenses. The lens sets for illuminating assemblies 3–6 transmit light from optic fiber bundles 11–14 to the viewing zone 2, and each set is designed to focus light on the center of the viewing zone.

The lens sets for viewing/IR assemblies 7 and 8 collect light reflected from objects in the viewing zone 2 and transmit it to optic fiber bundles 15 and 16. Each viewing/IR assembly lens set is preferably designed for infinite focus at the viewing zone end. The lens set for viewing/IR assembly 7 also collects IR from the viewing zone 2, and the lens set for viewing/IR assembly 8 also transmits IR to the viewing zone 2. The lens set for IR assembly 9 collects IR from an area below the viewing zone 2, and the lens set for IR assembly 10 transmits IR to the same area below the viewing zone 2.

Each assembly, 3–10, may require multiple lens sets to cover the end face of the corresponding optic fiber bundles 11–18. If multiple lens sets are used in an assembly they may be staggered in an arrangement like "bricks" to minimize the occurrence of blind spots.

The ends of the optic fiber bundles 15 and 16, which are remote from the viewing head 1, project the light that they transmit into lens arrays 21 and 22, respectively. The lens arrays 21 and 22 collect and focus the light and project it into dichroic filters 23 and 24.

Generally, dichroic filters separate light into two beams based on frequency. Dichroic filters contain a material that passes light above a certain frequency but reflects light below that frequency. The dichroic material is positioned in the filter at a 45° angle to the path of the entering light, and consequently, the reflected light emerges from the filter at a 90° angle from the path of the entering light while the non-reflected light passes straight through the filter.

Dichroic filters 23 and 24 use a material that reflects IR but passes light with frequencies higher than IR. Thus, dichroic filter 24 reflects IR transmitted to it by viewing/IR assembly 7 and passes light above that frequency which is transmitted to it by viewing/IR assembly 7. Dichroic filter 23, however, is used to project IR into optic fiber bundles 16 and 18. IR from an IR generator 27 is projected into the dichroic filter 23 such that it is transmitted via the optic fiber bundles 16 and 18 to the viewing zone 2. It should be appreciated that dichroic filter 23 receives light from the viewing zone 2 via optic fiber bundle 16 and passes this light.

The light that passes through dichroic filters 23 and 24 is then projected into dichroic filters 25 and 26, respectively. Dichroic filters 25 and 26 use a material that separates the light into two beams so that the beam that is passed includes "green" light and the beam that is reflected includes "red" light. Thus, dichroic filters 25 and 26 each produce a "red" and "green" beam of light. The individual beams of "red" and "green" light are directed to separate photo-amplifiers.

Fiber optic bundle 17 transmits IR collected by the lens set of IR assembly 9 to lens array 28. Lens array 28 collects and focuses the IR for transmittal to a photo-amplifier.

More illuminating assemblies and viewing/IR assemblies may be necessary or desirable depending on the size, shape, and nature of the object being viewed. Generally, sufficient illuminating assemblies and associated viewing/IR assemblies are required to view substantially all of the surface area of the objects being sorted. For example, four sets of assemblies with each set comprising two illuminating assemblies and one viewing/IR assembly may be spaced at 90° increments around the circumference of the viewing head.

If more viewing/IR assemblies are used, then the red and green light from each assembly is separated into individual red and green beams, respectively. Further, all IR collected by viewing/IR assemblies is separated into individual beams, and all IR that is collected by IR assemblies may be separated into individual beams.

The system of illuminating assemblies and associated optic fiber bundles, lens sets, lens array, and light source along with the viewing/IR assemblies and associated optic fiber bundles, lens sets, lens arrays, and dichroic filters comprise a detecting means. The detecting means optically detects discernible defects in objects being sorted.

The detecting means may be multichromatic or monochromatic. If a monochromatic detecting means is used then the dichroic mirrors 25 and 26 for separating light into two beams of different frequency are eliminated. It should be appreciated that a multichromatic detecting means may separate light at any frequency desired and may effect multiple separations as desired to optimize its ability to detect defects in a particular type of object.

The system of IR assemblies and viewing/IR assemblies and associated optic fiber bundles, lens sets, lens arrays, dichroic filters, and IR generator comprise an object sensing means. The object sensing means determines the presence, size, and rate of fall of an object being sorted. The sensing means may comprise electromagnetic energy other than IR as appropriate depending on the electromagnetic energy used for the detecting means and the nature of the objects being sorted.

It should be appreciated that the object sensing means comprises at least two separate sets of IR beams. Any number of IR beams may be used in each set, particularly where variation in object size is relatively large. For example, two IR beams may be arranged at an 90° angle such that the two IR beams intersect with each other and with the path of the object stream. The second set of IR beams is located such that it intersects the object stream in a plane that is different than the plane of the first set of IR beams.

SIGNAL PROCESSING MEANS AND ELECTRIC SIGNATURE PROCEDURE

The object to be sorted is introduced to the viewing zone and as the object passes through the viewing zone it intersects the first IR beam which determines the presence of an object in view and how long it takes the object to traverse the viewing zone. It should be appreciated that the signal from the viewing zone IR photo-amplifier will decrease proportionately to the degree of blockage caused by the section of the object in view, and if no decrease is detected then no object is in view. The output of the viewing zone and subviewing zone IR photo-amplifiers is therefore capable of determining when an object first enters the viewing area, how wide it is at any point of its length, and how long it is. At the same time that the viewing zone IR photo-amplifier is sensing an object, the red and green photo-amplifiers are determining the color of the section of the object in view. The outputs of the IR photo-amplifiers and the red and green photo-amplifiers are continuously processed and the result compared to the previously stored electric signature for acceptable objects.

Figure 3:
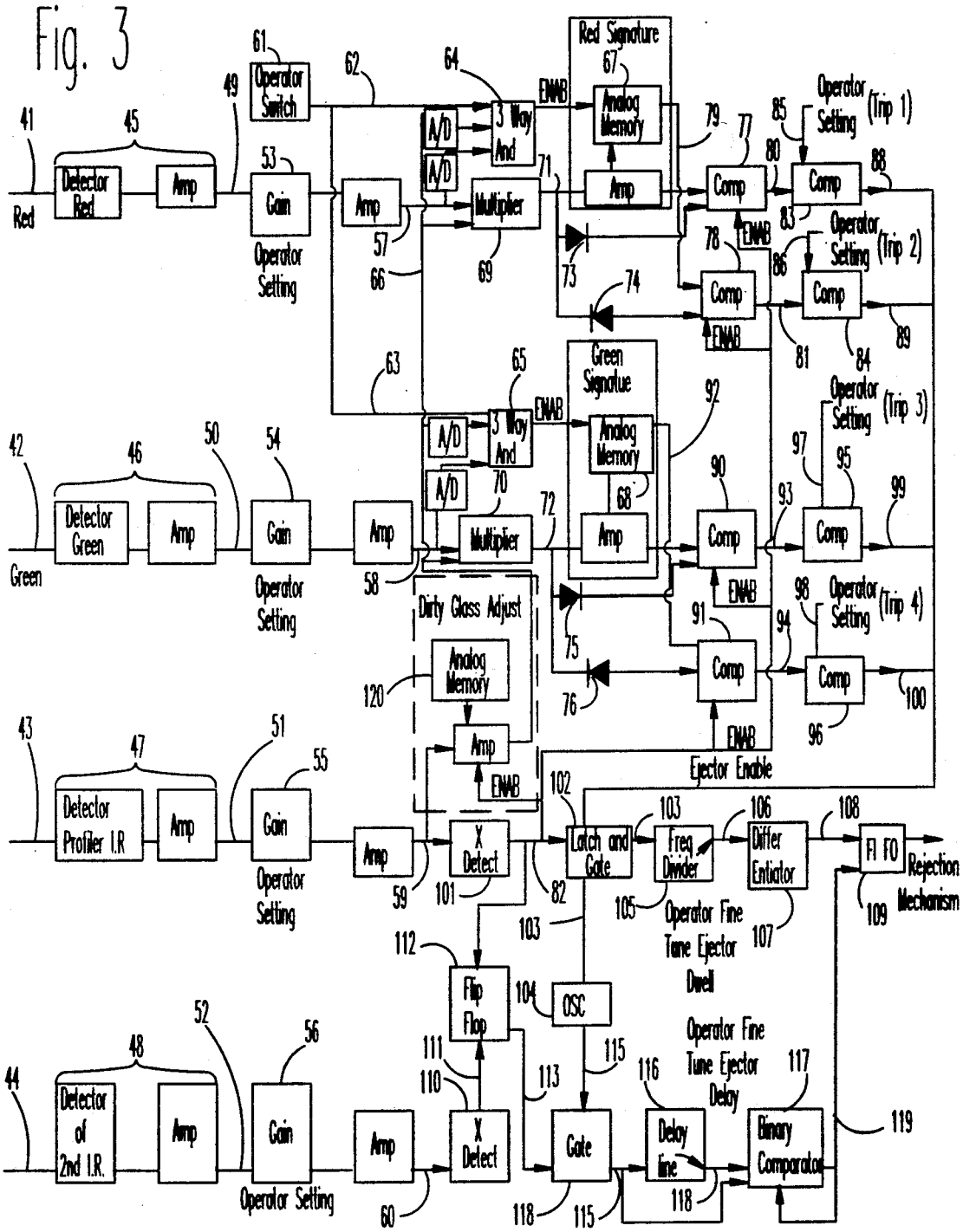
FIG. 3 is a schematic diagram of the signal processing means.

Referring to FIG. 3, the red beam 41, green beam 42, viewing zone IR beam 43, and subviewing zone IR beam 44 are detected by photo-amplifiers 45, 46, 47, and 48 which generate signals 49, 50, 51, and 52. These signals 49, 50, 51, and 52 are proportional to the intensity of the red beam 41, green beam 42, and IR beams 43 and 44 detected by the respective photo-amplifiers 45, 46, 47, and 48.

The operator has the ability to individually adjust each of the signal strengths for the four signals 49, 50, 51, and 52 by adjusting gain adjusters 53, 54, 55, and 56 to produce signals 57, 58, 59, and 60. The gain adjusters 53, 54, 55, and 56 may also include amplifiers. It may be necessary to increase or decrease the signal strength for signals 49 and 50 from red and green photo-amplifiers 45 and 46 depending on the intensity of the defects on the objects to be sorted.

The gain adjusters 55 and 56 may be used to increase the signal strength for signals 51 and 52 for IR beams 43 and 44 depending on the degree of blockage of the beams caused by the average size of the object to be sorted. For example, if the size of the object is almost the full width of the beam, the gain will need to be increased to compensate for the reduced amount of IR beam not blocked by the object.

When no object is in the viewing zone, signals 57 and 58 from the red and green photo-amplifiers 45 and 46 are zero and signal 59 is at its maximum value because no object is present to reflect light and block the viewing zone IR beam. Similarly, when no object blocks the subviewing zone IR beam, signal 60 is at its maximum value.

During the electric signature setting procedure, the operator sets switch 61 to the on position and then feeds preselected acceptable objects through the viewing zone. Switch 61 produces signals 62 and 63 when it is in the on position, and also clears both analog memories 67 and 68. Signals 62 and 63 are fed to 3-way AND gates 64 and 65, respectively. Signal 57 is converted by an analog to digital converter to a digital signal and fed to 3-way AND gate 64. Signal 58 is also converted by an analog to digital converter and fed to 3-way AND gate 65. It should be appreciated that the analog to digital converters for signals 57 and 58 will only give a positive digital signal when signals 57 and 58 give a positive, analog signal indicating that red or green beams of light are being detected, respectively.

Signal 66, which is derived from signal 59 for the viewing zone IR beam, is also converted by analog to digital converters and fed into both 3-way AND gates 64 and 65. Again, the analog to digital converters for signal 66 will only give a positive, digital signal when signal 66 is a positive, analog signal indicating the presence of an object in the viewing zone that is blocking the viewing zone IR beam. When 3-way AND gates 64 and 65 receive positive, digital signals from each of their three inputs, they generate an enabling signal to the red and green analog memories 67 and 68, respectively.

At the same time that the red and green analog memories are being enabled, signals 57 and 66 in analog form are fed to multiplier 69, and signals 58 and 66 in analog form are fed to multiplier 70. Multiplier 69 multiplies signal 57 by signal 66 to produce signal 71. Multiplier 70 multiplies signal 58 by signal 66 to produce signal 72. Signals 71 and 72 are fed to amplifiers and then fed to the red and green analog memories 67 and 68, respectively. When the operator notes that the values for signals 71 and 72 have achieved a stable level as indicated by a simple voltage level indicator (not shown), he switches off switch 61 causing signals 71 and 72 to be stored in the red and green analog memories 67 and 68 as the red and green signature for acceptable objects.

After the red and green electric signatures are determined and the gain settings 53, 54, 55, and 56 are selected, the object to be sorted is conveyed through the viewing zone. A signal 71 will be generated as described above but for the object to be sorted. Signal 71 is then split and fed to steering diodes 73 and 74. If signal 71 is positive, steering diode 73 allows the positive amplitude of the signal to pass on to comparator 77, which also contains an AND gate, otherwise the output of steering diode 73 is zero. If signal 71 is negative, steering diode 74 allows the negative amplitude of the signal to pass on to comparator 78, which also contains an AND gate, otherwise the output of steering diode 74 is zero. The output signal 79 which is the red electric signature of the red analog memory 67 is continuously fed to both comparator 77 and comparator 78. Comparators 77 and 78 generate signals 80 and 81 which are proportional to the difference between the red electric signature and the signals from steering diodes 73 and 74, but only if the comparator has also been enabled by signal 82 indicating that an object is being viewed which is derived from signal 59 for the viewing zone IR beam, and only if the output from the respective steering diodes is not zero, thus indicating that a signal derived from signal 71 is being applied.

Signals 80 and 81 are fed to comparators 83 and 84. A trip level 85 set by the operator is also fed to comparator 83 which causes the comparator to generate an output signal 88 if signal 80 exceeds the preselected trip level 85. Likewise, a preset trip level 86 is fed into comparator 84 which causes the comparator 84 to generate an output signal 89 if signal 81 exceeds the preset trip level 86.

If signal 72 which is responsive to the green beam reflected from the object to be sorted is positive, steering diode 75 allows the positive amplitude of signal 72 to be fed to comparator 90. Likewise, if signal 72 is negative, steering diode 76 allows the negative amplitude of signal 72 to be fed to comparator 91. The green electric signature, signal 92, from the green analog memory 68 is continuously fed to comparators 90 and 91. Comparator 90 generates an output 93 that is indicative of the difference between the green electric signature and the positive amplitude of signal 72. Likewise, comparator 91 generates a signal 94 that is indicative of the difference between the green electric signature and the negative amplitude of signal 72. Signals 93 and 94 are only generated by comparators 90 and 91 if enabling signal 82 which indicates an object is being viewed is present at comparators 90 and 91, and only if the output from the respective steering diodes is not zero, thus indicating that a signal derived from signal 71 is being applied. Signal 93 is fed into comparator 95 along with trip level 97 set by the operator, and comparator 95 generates an output signal 99 if signal 93 exceeds trip level 97. Likewise, signal 94 is fed into comparator 96 along with trip level 98 set by the operator, and the comparator 96 generates an output signal 100 if signal 94 exceeds trip level 98.

Signal 59 is fed to zero cross detector 101 which generates signal 82. The zero cross detector 101 only generates signal 82 when signal 59 falls below its maximum value indicating that the viewing zone IR beam is being partially blocked by an object being viewed. Thus, signal 82 will only be generated if an object is being viewed. As noted above, signal 82 is then used to enable comparators 77, 78, 90, and 91. Signals 88, 89, 99, and 100, if generated, are fed to latch gate 102 along with signal 82. If signal 82 and any of signals 88, 89, 99, or 100 are present at latch gate 102, then signal 103 from oscillator 104 is passed by latch gate 102 onto frequency divider 105. It should be appreciated that this situation will occur only when an object is both present in the viewing zone and has been determined to have a defect by an output signal from comparators 83, 84, 95, or 96. The frequency divider 105 is adjustable by the operator for different types of objects and typically will be about 50% to 75% of the incoming frequency.

The output 106 of the frequency divider 105 is fed to a differentiater 107. The differentiater 107 generates an output 108 for as long as it receives a signal 106 from the frequency divider 105. The signal 108 is stored by the first in, first out (FIFO) storage device 109 for as long as the signal 108 occurs. It should be appreciated that the signal 108 stored by the FIFO 109 is indicative of the length of time that it takes a defective object to traverse the viewing zone. This signal is then used by the FIFO 109 to determine the dwell time that the rejection mechanism is activated for rejecting that defective object.

Signal 60, which is proportional to the subviewing zone IR beam, is fed to zero cross detector 110 where it generates a signal 111 which occurs only when signal 60 is below its maximum value indicating that an object has interrupted the subviewing zone IR beam. When signal 82 from zero cross detector 101 is first generated indicating that an object has interrupted the viewing zone IR beam, it activates flip flop circuit 112. When the same object interrupts the subviewing zone IR beam, the signal 111 from the zero cross detector 110 for the subviewing zone IR beam deactivates the flip flop circuit 112. Between the time when the flip flop circuit 112 is activated by signal 82 and deactivated by signal 111, it outputs a signal 113 which is fed to gate 114. A signal 115 from the oscillator 104 is constantly fed to gate 114.

The gate 114 passes the oscillator signal 115 onto the delay line 116 only when the signal 113 from the flip flop circuit is present. The signal 115 is also fed directly into a binary comparator 117. At the same time, the delay line 116 gives an output 118 which is fed to the binary comparator 117. The binary comparator 117 gives an output 119, but only when signal 118 has equaled signal 115. This only occurs when the amount of time indicated by signal 115 plus the amount of delay time added by the operator with the delay line 116 has occurred. Therefore, the operator has the ability to delay the output 119 of the binary comparator for as long as desired by adjusting delay line 116. The output 119 of the binary comparator 117 is indicative of the amount of time it will take for the defective object to reach the rejection mechanism, and is used to start the rejection mechanism at the proper time. The output 119 of the binary comparator 117 is also fed back to the binary comparator 117 to reset it so that it is ready to determine the delay time for the next object.

The signal 119 from the binary comparator 117 is fed to the FIFO device 109 along with the signal 108 which is representative of the dwell time of the object. The FIFO device 109 acts by starting the rejection mechanism when it receives the signal 119 from the binary comparator 117 and keeps the rejection mechanism activated for as long as indicated by the signal 108.

It must be appreciated that in operation there may be a number of objects in transit between the first and second IR beams each one of which may require individual dwell and delay adjustments. This will require more latching, storing and timing circuits but these have been left out of this discussion in the interest of clarity.

The individual outputs 88, 89, 99, and 100 can also be sent to a FIFO and binary comparator device and this will enable the operator to select the number of pulses per output for individual pulses of the zero cross detector. This enables the operator to select, for example, an object that has only two defects as determined by signal 88 but reject an object with 3 defects from signal 88. It must be appreciated that any combination of number of defects can be selected by the operator based on any or all of the signals 88, 89, 99, and 100.

Similarly, these signals can be processed, stored and compared to an oscillator output acting as a real time clock and the rejection mechanism operated based on length of time individual defects were detected. This gives the operator the ability to accept or reject objects with defects above or below a certain size.

When the operator is setting the red and green electric signature for an acceptable object, the first IR beam 43 is changing from a strong signal to a lesser signal depending on the degree of blockage caused by the size of the object in view. However, in operation the viewing glass may become covered with a layer of dust and this will decrease the level of IR being detected even when no object is in view. This will adversely affect the gain of the signals 57 and 58.

This problem is addressed by the signal processing means bounded in the area titled "Dirty Glass Adjust". Signal 82, the output of the zero cross detector 101, is used to enable the amplifier and analog memory 120. When signal 82 gives the closest signal to maximum possible and thus signifies that no object is in view the "Dirty Glass Adjust" circuit is enabled and the output 66 of the amplifier is allowed to change from the previous setting. No change will occur if the signal strength 59 is the same as the last time it was adjusted.

The new signal 66 is then applied to the red and green multipliers 69 and 70 and this new setting effectively overcomes the effect of loss of signal strength caused by dust on the viewing surfaces. It must be appreciated that this adjustment can be up or down depending on whether the glass is cleaner or dirtier than it was at the last adjustment.

The strongest IR signal 59 obtained with clean glass is stored in a comparator not shown in FIG. 3 and powered by a stand-by battery. When the operator selects the electric signature sequence this stored signal is compared with the IR signal 59 detected and if it determines the glass is dirty, the operator is alerted by a commercially available alarm so that the glass can be cleaned before the electric signature procedure is commenced.

Signal 113 can be sampled and the frequency generated by flip-flop 112 maintained as a constant by adjusting the feeder circuit (not shown) to maintain a constant flow rate through the viewing zone 2.

Signal 82 can be sampled and its amplitude or duration, or both, compared with stored values and the rejection mechanism activated if the sampled values differ from the stored values by more than a predetermined amount.

It must be appreciated that the block diagram in FIG. 3 is described as primarily an analog circuit and the preferred method of implementation is to multiplex the signals 57, 58, 59, and 60, and convert them to digital pulses by commercially available analog to digital converters and process all of the signals including the electric signature, ejector dwell and ejector delay, trip settings, dirty glass adjust, number and size of defects, etc. by digital instead of analog technology.

The preferred Digital Signal Processor is a Texas Instrument TMS320E15JD but any suitable commercially available item could be used. In this embodiment, the gain adjustments 53, 54, 55, and 56 are preferred to be digital to analog converters which may be adjusted both by the operator during initial setting up of the machine and by the processor during operation.

In the preferred embodiment, all operator adjustments should be performed via panel switches which may be first processed by a microprocessor.

REJECTION MECHANISM

Referring to FIG. 2, a rejection mechanism 28 is shown. The rejection mechanism comprises a commercially available solenoid actuated valve that controls a supply of compressed air. The rejection mechanism 28 is located proximate to the object stream below the viewing head 1 and, when activated, provides a jet of air which deflects a defective object from the normal path of the object stream.

It will be appreciated that various modifications or alterations may be introduced into the apparatus and method described without departing from the spirit or ambit of the invention. For example, the detecting means may be multichromatic or monochromatic, or the operation of the apparatus and method may be based on sensing of the light transmitted through the object being sorted rather than on the light reflected by it. Furthermore, those of skill in the field of digital signal processing may implement the processing of data in digital form in alternative ways to carry out the teachings hereof.

What is claimed is:

1. A method for distinguishing unacceptable objects which differ in size and coloration from acceptable objects, the method comprising the steps of:

a) passing an acceptable object through a viewing zone;

b) projecting an effective amount of first radiation on the acceptable object as it passes through the viewing zone;

c) detecting a portion of said first radiation reflected by the acceptable object, and generating an electric signal proportional to the intensity of the first radiation detected;

d) projecting a beam of a second radiation across the viewing zone such that the acceptable object blocks a portion of the beam proportionate to the acceptable object's size as the acceptable object passes through the viewing zone;

e) detecting the portion of said beam of a second radiation not blocked by the acceptable object as it passes through the veiling zone, and generating a second electric signal proportional to the amount of said beam of a second radiation not blocked by the acceptable object f) storing the first and second electric signals as a reference electric signature for acceptable objects;

g) repeating steps (a) through (e) hereof for an object to be sorted;

h) comparing said first electric signal for the object to be sorted with said first electric signal of said electric signature for acceptable objects, and generating a difference signal if the difference between the compared signals exceeds a pre-selected value; and i) comparing said second electric signal for the object to be sorted with said second electric signal of the reference electric signature for acceptable objects, and generating a difference signal if the difference between the compared signals exceeds a pre-selected value.

2. The method of claim 1 which further comprises projecting a second beam of the second radiation across the path of object movement through said viewing zone that is different than said first beam such that the electric signals of the first and second beams are processed to determine the rate of movement of objects in said viewing zone.

3. The method of claim 1 wherein:

a) the electrical signal for said beam of the second radiation that pass across the veiwing zone are summed with an electric signal substantially equivalent in magnitude to the electric signal produced by said beam when no object is being viewed;

b) the electric signal for the radiation reflected by the objects being viewed is adjusted by a factor such that when an acceptable object of that type is being viewed the electric signal will be substantially equivalent in magnitude to the electric signal from step (a) hereof;

c) the electric signal for the radiation reflected by the objects being viewed is summed with the electric signal produced from step (a) hereof; and d) the summed electric signal produced in step (c) hereof is summed with a reference electrical signal corresponding to the signal produced from step (c) hereof for acceptable objects.

4. Apparatus for sorting an unacceptable object moving in an object stream which differs in size and color from an acceptable object moving in the object stream wherein the differences between acceptable and unacceptable objects are detectable by an appropriate radiation, comprising:

a) an object viewing zone;

b) a source of appropriate first radiation arranged to project the first radiation on each object as it passes through the viewing zone;

c) a detector arranged such that the first radiation reflected from an object passing through the viewing zone is received by the detector and converted into a first electric signal which is function of the amount of the first radiation received by the detector;

d) means for processing and saving said first electric signal as a first component of an electric signature for objects that have been designated as acceptable;

e) a source of appropriate second radiation that is different than the radiation used for said source of the appropriate first radiation;

f) means for transmitting said second radiation from its source to the viewing zone;

g) means for projecting said second radiation across the veiling zone such that each object blocks a portion of the beam proportionate to the object's size as the object passes through the viewing zone;

h) means for receiving said second radiation projected across the viewing zone and transmitting it to a detector;

i) a detector capable of converting said second radiation projected across the viewing to a second electric signal proportional to the intensity of the energy detected;

j) means for processing and saving said second electrical signal as a second component of said electric signature for objects that have been designated as acceptable;

k) means for comparing the electric signal for each object being sorted with the electric signature for acceptable such objects to generate a difference electrical signal reflecting any difference between the object being sorted and an acceptable object; and l) means responsive to pre-selected level of said difference electric signal for rejecting objects whose difference electric signal exceeds the pre-selected value.

5. Apparatus according to claim 4, wherein said source of appropriate first radiation is light.

6. Apparatus according to claim 1, wherein said source of appropriate first radiation is light and is remote from the object viewing zone and includes an optic fiber adapted to transmit said light from the remote source through the viewing zone.

7. Apparatus according to claim 4, wherein said source of appropriate first radiation is light and directs said light to the viewing zone in such a way that when no objects are in the viewing zone no light is detected by the detector.

8. Apparatus according to claim 4, wherein said source of appropriate first radiation is light and said detector is remote from the viewing zone and includes an optic fiber adapted to transmit reflected light from the viewing zone to the detector.

9. Apparatus according to claim 4, wherein said source of appropriate first radiation provides light having a range of frequencies, and wherein the apparatus further comprises at least one dichroic filter to separate the light into a plurality of beams of different frequency ranges.

10. Apparatus according to claim 4, further comprising a lens which has an infinite focus arranged such that it collects and focuses radiation reflected from the objects passing through the viewing zone and transmits said radiation to the detector.

11. Apparatus of claim 4, wherein said second radiation is in the infrared (IR) region of the radiation spectrum.

12. Apparatus of claim 11, further comprising a plurality of optical fibers for transmitting said second radiation from its source to the viewing zone and from the viewing zone to the detector.

13. Apparatus of claim 12, further comprising:

a) a source of visible light;

b) bifurcated fiber optic bundles such that each bundle receives said visible and said IR light at the end adjacent to the viewing zone and transmits both the visible light and IR light to a first bifurcated end adjacent to the first radiation detector and to a second bifurcated end located adjacent to the second radiation source.

14. Apparatus of claim 13, further comprising bifurcated fiber optic bundles such that each bundle receives visible light and projects IR light at the end adjacent to the viewing zone and transmits visible light to a first bifurcated end located adjacent to the detector and receives IR light at a second bifurcated end located adjacent to the second radiation source.

15. Apparatus of claim 12, further comprising:

a) a source of visible light;

b) bifurcated fiber optic bundles such that each bundle receives said visible and said IR light at the end adjacent to the viewing zone and transmits both the visible light and IR light to a first bifurcated end adjacent to the first radiation detector and to a second bifurcated end located adjacent to the second radiation detector.

16. Apparatus of claim 4, where the rejecting means rejects objects into different groupings depending on the magnitude of the difference signals.

* * * * *